US007800498B2

(12) United States Patent
Leonard et al.

(10) Patent No.: US 7,800,498 B2
(45) Date of Patent: Sep. 21, 2010

(54) OCCUPANCY SENSOR POWERBASE

(75) Inventors: Thomas W. Leonard, Tualatin, OR (US); Richard A. Leinen, Wilsonville, OR (US); John B. Engel, Tigard, OR (US)

(73) Assignee: Leviton Manufacturing Co., Inc., Melville, NY (US)

( * ) Notice: Subject to any disclaimer, the term of this patent is extended or adjusted under 35 U.S.C. 154(b) by 477 days.

(21) Appl. No.: 11/692,749

(22) Filed: Mar. 28, 2007

(65) Prior Publication Data

US 2007/0229297 A1 Oct. 4, 2007

Related U.S. Application Data

(60) Provisional application No. 60/786,952, filed on Mar. 29, 2006.

(51) Int. Cl.
*G08B 13/14* (2006.01)

(52) U.S. Cl. ..... 340/568.2; 340/539.23; 340/540; 340/541

(58) Field of Classification Search ..... 340/568.2, 340/539.22, 539.23, 540, 541
See application file for complete search history.

(56) References Cited

U.S. PATENT DOCUMENTS

| | | | | |
|---|---|---|---|---|
| 3,653,021 | A | 3/1972 | Litman et al. | |
| 4,793,814 | A | 12/1988 | Zifcak et al. | |
| 5,017,783 | A | 5/1991 | Mousavi | |
| 5,026,990 | A | 6/1991 | Marman et al. | |
| 5,155,905 | A | 10/1992 | Miller, Jr. et al. | |
| 5,221,919 | A * | 6/1993 | Hermans | 340/567 |
| 5,258,889 | A | 11/1993 | Belanger, Jr. | |
| 5,393,256 | A | 2/1995 | Mitchell et al. | |
| 5,497,305 | A | 3/1996 | Pastrick et al. | |
| 5,763,830 | A | 6/1998 | Hsueh | |
| D401,175 | S | 11/1998 | Bender et al. | |
| D404,325 | S | 1/1999 | Bender et al. | |
| D404,326 | S | 1/1999 | Bender et al. | |
| 6,082,894 | A | 7/2000 | Batko et al. | |
| 6,155,887 | A | 12/2000 | Cuff et al. | |
| 6,222,191 | B1 * | 4/2001 | Myron et al. | 250/353 |
| 6,326,776 | B1 | 12/2001 | Yoshiuchi et al. | |
| 6,663,414 | B2 | 12/2003 | Kume et al. | |
| 6,850,159 | B1 * | 2/2005 | Mudge | 340/541 |
| 7,195,381 | B2 | 3/2007 | Lynam et al. | |
| 7,306,493 | B2 | 12/2007 | Seo et al. | |

(Continued)

OTHER PUBLICATIONS

Leviton, Low Voltage Switches, LIT-32712-00 Rev B, Tualatin, OR, Feb. 8, 2005, 2 pp.

(Continued)

*Primary Examiner*—Toan N Pham
*Assistant Examiner*—Kerri McNally
(74) *Attorney, Agent, or Firm*—Marger Johnson & McCollom PC

(57) ABSTRACT

The present invention discloses an apparatus and method for converting a low voltage occupancy sensor to a powered stand-alone unit. The invention uses a low voltage occupancy sensor mounted in an upper portion of a housing with its associated low voltage wiring terminating in a terminal block. An attachable corresponding lower housing is provided with a power pack adapted to connect with the low voltage terminal block wherein once combined the upper and lower housing portions combine to form an integral powered stand-alone sensor unit.

21 Claims, 2 Drawing Sheets

U.S. PATENT DOCUMENTS

| | | | | |
|---|---|---|---|---|
| 7,445,455 | B2 | 11/2008 | Yokozuka et al. | |
| 2005/0043907 | A1* | 2/2005 | Eckel et al. | 702/62 |
| 2006/0138329 | A1 | 6/2006 | Wu et al. | |
| 2006/0194504 | A1 | 8/2006 | Ragonetti et al. | |
| 2007/0030154 | A1* | 2/2007 | Aiki et al. | 340/572.7 |
| 2007/0040676 | A1* | 2/2007 | Bandringa et al. | 340/567 |
| 2007/0085755 | A1 | 4/2007 | Webb et al. | |
| 2007/0184679 | A1 | 8/2007 | Schmid | |
| 2007/0264849 | A1 | 11/2007 | Steckler et al. | |

OTHER PUBLICATIONS

Patent Cooperation Treaty, Written Opinion of the International Searching Authority, PCT/US2006/32965, Jan. 19, 2007, 4 pages.

Patent Cooperation Treaty, International Search Report, PCT/US2006/32965, Jan. 19, 2007, 3 pages.

Sensorswitch Speciality Power Packs, Sensor Switch, Inc., Wallingford, CT, Dec. 21, 2004, 2 pages.

International Search Report, PCT/US2007/065523 dated Aug. 5, 2008 (1 page).

* cited by examiner

OCCUPANCY SENSOR POWERBASE

This application claims the benefit of priority pursuant to 35 U.S.C. 119(e) from a U.S. Provisional Application having Application No. 60/786,952 filed Mar. 29, 2006.

FIELD OF THE INVENTION

The present invention relates to the field of electrical connectors and enclosures.

BACKGROUND OF THE INVENTION

Electrical devices such as occupancy sensors and motion detectors have become commonplace in both residential and commercial construction applications. Proper installation of these devices requires that they be placed accurately to perform their desired function. Moreover, since the proper functioning of these devices is sensitive to their placement it is desirable for an installer to be able to install, replace, repair and inspect these devices without extensive disassembly or displacement of these units from the locations in which they were originally installed.

Today, automation systems that include sensors are being installed in more and more buildings, including both new construction and structures that are being rebuilt. The incentives for putting automation systems into a building are numerous. High on the list are occupancy sensors to help reduce costs by turning off lights when a person leaves a room, more efficient use of energy, simplified control of building systems, ease of maintenance and of effecting changes to the systems. Facility managers would prefer to install systems that can interoperate amongst each other. Interoperability is defined by different products, devices and systems for different tasks and developed by different manufacturers, being able to be linked together to form flexible, functional control networks.

An example of a typical automation system includes security systems that include occupancy sensors and/or lighting controls, HVAC systems, etc., all possibly provided by different manufacturers. It would be desirable therefore if these separate disparate systems could be quickly and easily mounted to a standard outlet box.

Prior art systems generally comprise closed proprietary equipment supplied by a single manufacturer. In these systems, the installation, servicing and future modifications of the component devices in the systems are restricted to a single manufacturer's product offering and technical capability. In addition, it is very difficult or impossible to integrate new technology developed by other manufacturers. In the instances where technology from other manufactures can be integrated, it is usually too costly to consider.

It is desirable, therefore, to create a system wherein individual sensors, processors and other components can be easily mounted to an outlet box. A few of the benefits of using an open system include an increased number of design options for the facility manager, lower design and installation costs, since the need for customized hardware is greatly reduced, and simplified and quicker system startup.

An integral part of any automated control system are the sensors and transducers used to gather data on one or more physical parameters such as occupancy or motion for example. It would be desirable, therefore, if a plurality of sensor functions could be quickly and easily fitted into a standard single wall box opening and be able to be powered and communicate with one or more control units, i.e., processing nodes, on the control network.

The number and types of sensors in this device could be many including multiple, dual or singular occupancy and security sensing via means including passive infrared, ultrasonic, RF, audio or sound or active infrared. In addition, other multiple or singular transducers may be employed such as temperature sensor, relative humidity sensor, ambient light sensor, CO sensor, smoke sensor, security sensor, air flow sensors, switches, etc.

The utility of such a multifunction sensor can best be described by an example. In order to minimize the number of unique devices that are installed in a room, it is desirable to have a sensor device reliably perform as many functions as possible as this reduces the wiring costs as well as the number of devices required to be installed on the walls of the room. Additionally, from an aesthetic point of view, architects are under increasing demand by their clients to reduce the number of unique sensor nodes in any given room.

Further, it is also desirable to have these transducers or sensors communicate with a microprocessor or microcontroller that can be used to enhance the application of the transducer and be powered by a stand alone unit which includes both the sensor and the power pack which can be a printed circuit board including components in a single enclosure.

At the present time low voltage sensors such as occupancy sensors can be wired to a relay or dimmer panel, or to a localized power pack that houses a single load relay and generates the low voltage power for the sensor. Another option of wiring low voltage sensors is with a stand-alone unit that includes both the occupancy sensor and the power pack in a single enclosure. This approach can be problematic in that it usually requires a manufacturer to produce an additional product line to fulfill the stand-alone requirements that is costly and inefficient.

SUMMARY OF THE INVENTION

The present invention is directed to an electrical device enclosure that is easy to install, easy to manufacture, allows a device to be self-contained, and preserves the placement of the original device when a replacement device is installed.

This invention is directed toward an enclosure assembly for a sensor power pack and a sensor, such as an occupancy sensor, which can be easily mounted to an electric outlet box. The assembly disclosed can include a circuit board, a chassis base, a chassis cover, a harmonic wheel for mounting a sensor and a slip-on screw terminal block.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do nor depart from the spirit and scope of the invention in its broadest form.

BRIEF DESCRIPTION OF THE DRAWINGS

The accompanying drawings, which are included to provide a farther understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
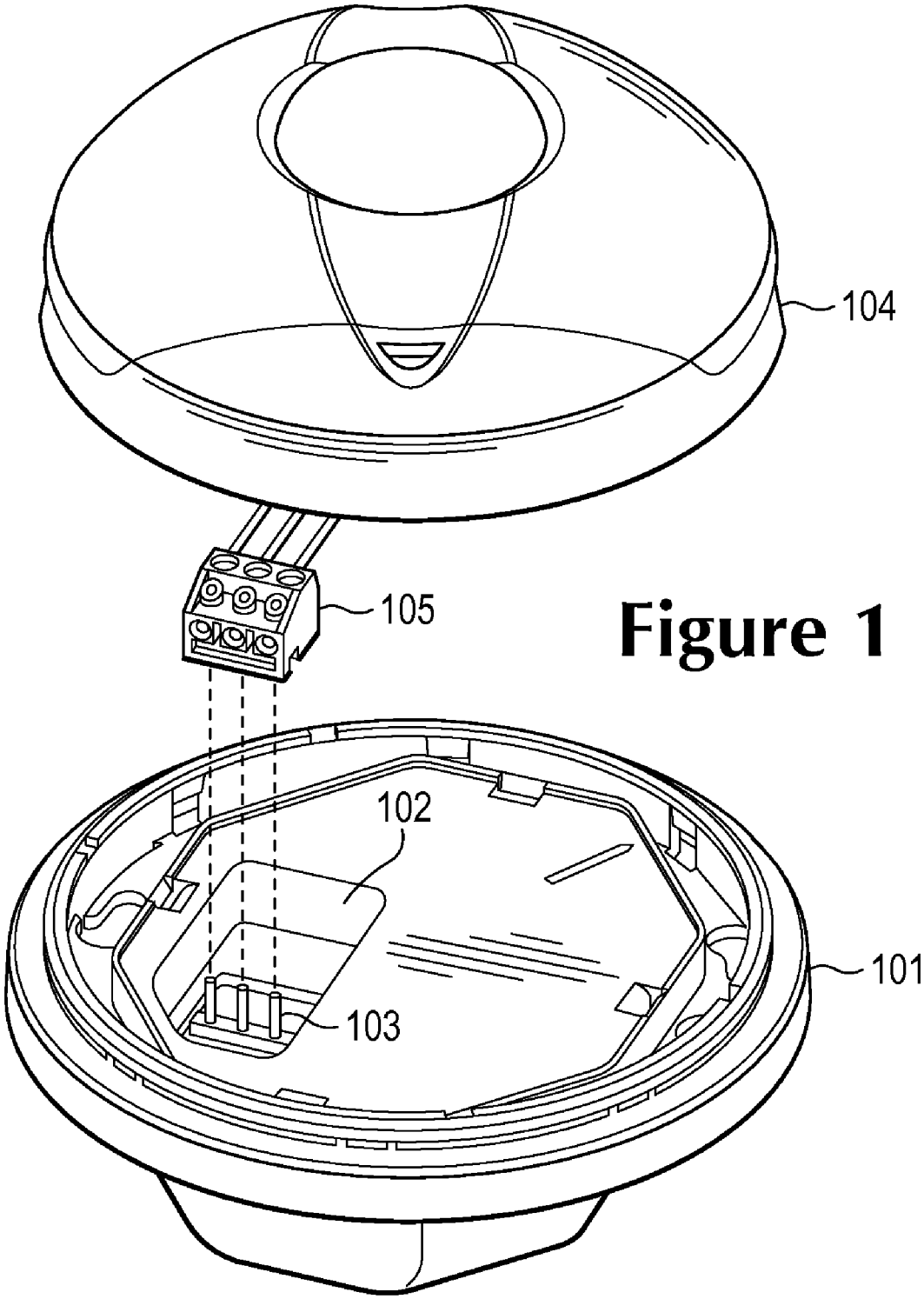
FIG. 1 depicts the upper and lower portions of a housing in accordance with an embodiment of the present invention.

Referring now to FIG. 1, the housing of an embodiment of the present invention includes an upper portion 104 and a lower portion 101. In a preferred embodiment, upper portion 104 comprises a low voltage occupancy sensor and associated wiring. The occupancy sensor wiring of upper portion 104 terminates in a terminal block 105. The terminal block 105 is adapted to connect to terminals 103 located in a terminal cavity 102 located in lower housing portion 101. Lower portion 101 contains power electronics to operate the sensor housed in upper portion 104. Upper portion 104 and lower portion 101 combine to form a singular unit and are connected to one another by a harmonic wheel such that the upper portion 104 cooperatively and fixedly engages lower portion 101 to form a singular unit. The composite housing formed by upper and lower portions 104 and 101 respectively may be adapted to be mounted in a 4 inch octagonal electrical box as shown in FIG. 2.

Figure 2:
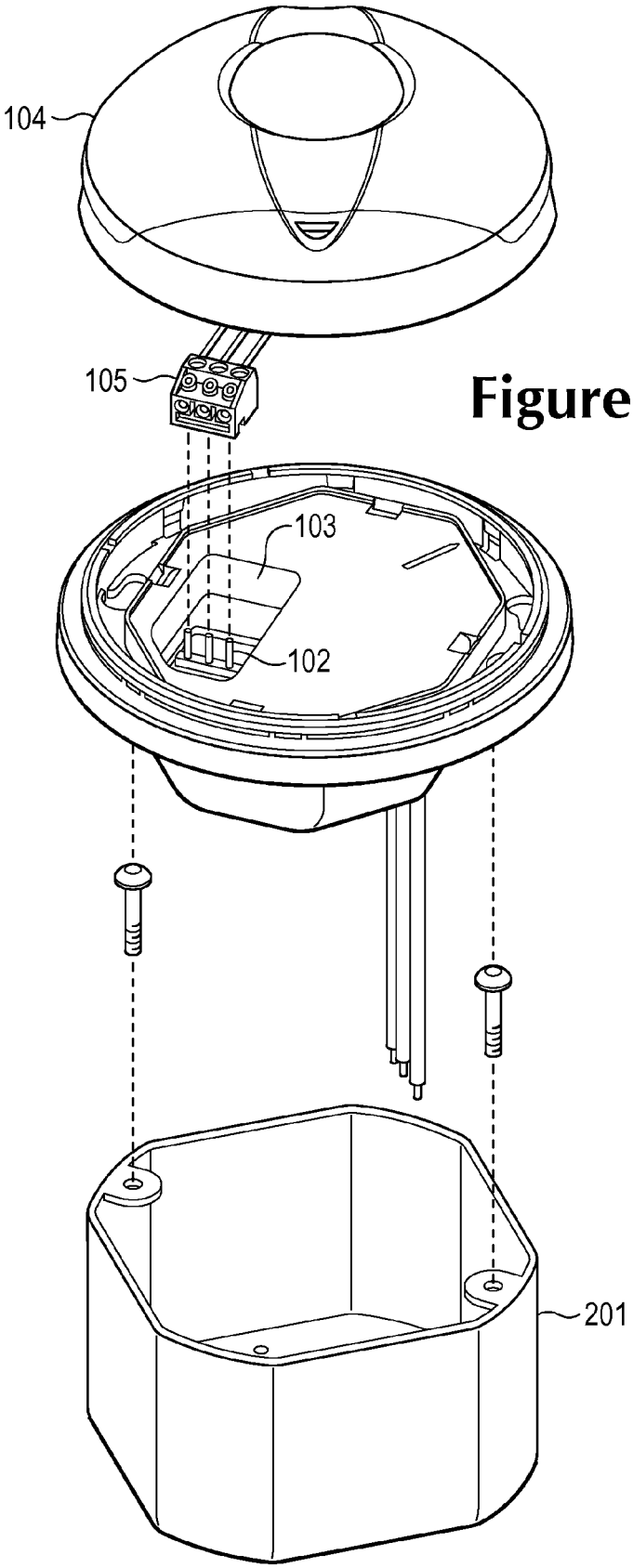
FIG. 2 depicts an exploded view of the upper and lower portions of a housing in accordance with an embodiment of the present invention and an octagonal mounting box.

Referring to FIG. 2, upper housing 104, attaches to lower housing 101 and the combined housing derived from the combination is mounted in octagonal box 201. By adapting the upper housing to contain a terminal block 105 for the low voltage wiring of the occupancy sensor and adapting the lower housing 101 to contain the electronics to power the sensor mounted in housing 104, the housing of the present embodiment allows the conversion of any low voltage occupancy sensor to a stand-alone unit.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A housing for mounting an electronic wiring device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where the lower portion is adapted to be mounted to a structure surface and said lower portion of said housing further comprises:

at least one input conductor adapted to be electrically connected to line voltage, and at least one output conductor adapted to supply said upper portion with low voltage, where said lower portion is structured to reduce said line voltage to said low voltage and supply said low voltage to said upper portion, where said power pack reduces said line voltage to said low voltage, and where said power pack further comprises a switching mode power supply.

2. The housing for mounting an electronic wiring device according to claim 1 wherein said sensor is an occupancy sensor.

3. The housing for mounting an electronic wiring device according to claim 1 wherein said upper portion attaches to said lower portion with a harmonic wheel.

4. The housing for mounting an electronic wiring device according to claim 1 further comprising a terminal block.

5. The housing for mounting an electronic wiring device of claim 4, where said terminal block is adapted to connect to terminals located in a terminal cavity of said lower portion.

6. The housing for mounting an electronic wiring device of claim 1 where said power pack further comprises a transformer.

7. The housing for mounting an electronic wiring device of claim 4, where said control wiring of said upper portion terminates in said terminal block.

8. The housing for mounting an electronic wiring device of claim 1, where said power pack further comprises power electronics to operate said sensor in said upper portion.

9. The housing for mounting an electronic wiring device of claim 1, where said singular unit is adapted to be mounted in an octagonal electrical box.

10. An occupancy sensor housing, comprising:

an upper portion including a low voltage occupancy sensor and wiring terminals; and a lower portion including:

a power pack and terminals, where the terminals are located in a terminal cavity of the lower portion, adapted to receive the wiring terminals of the upper portion, the power pack including power electronics to operate the low voltage occupancy sensor;

at least one input conductor adapted to be electrically connected to line voltage; and at least one output conductor adapted to supply the upper portion with a low voltage, where the upper portion engages the lower portion to form a singular unit, and the power pack reduces the line voltage to the low voltage.

11. The occupancy sensor housing of claim 10, further comprising:

a harmonic wheel to cooperatively engage the upper portion to the lower portion to form the singular unit.

12. The occupancy sensor housing of claim 10 where the lower portion is adapted to be mounted on a surface.

13. The occupancy sensor housing of claim 10, where the wiring terminals terminate in a terminal block of the upper portion, and the terminals of the lower portion are adapted to receive the terminal block.

14. A method comprising:

engaging a base to a low-voltage occupancy sensor to form a singular unit;

coupling power electronics in the base to the low-voltage occupancy sensor, thereby converting the low-voltage occupancy sensor to a stand-alone unit; and engaging the base to a standard building electrical box, where the building electrical box comprises a 4 inch octagonal building electrical box.

15. A housing for mounting an electronic device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where said upper portion attaches to said lower portion with a harmonic wheel.

16. The housing for mounting an electronic device of claim 15 where the lower portion is adapted to be mounted on a structure surface and said lower portion of said housing further comprises:

at least one input conductor adapted to be electrically connected to line voltage, and at least one output conductor adapted to supply said upper portion with a low voltage, where said power pack reduces said line voltage to said low voltage.

17. A housing for mounting an electronic device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where said upper portion further comprises a terminal block adapted to connect to terminals located in a terminal cavity of said lower portion.

18. A housing for mounting an electronic device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where said upper portion further comprises a terminal block; and said control wiring of said upper portion terminates in said terminal block.

19. A housing for mounting an electronic device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where said singular unit is adapted to be mounted in an octagonal electrical box.

20. A housing for mounting an electronic wiring device comprising:

an upper portion comprising a sensor; said sensor further comprising low voltage control wiring; and a lower portion shaped to fixedly attach to said upper portion to form a singular unit and comprising a power pack wherein when said upper and lower portions are combined the combination comprises a self-powered sensor, where said lower portion is structured to reduce line voltage to a low voltage and supply said low voltage to said upper portion, and where said singular unit is adapted to be mounted in an octagonal electrical box.

21. An occupancy sensor housing, comprising:

an upper portion including a low voltage occupancy sensor and wiring terminals; and a lower portion including:

a power pack and terminals adapted to receive the terminals of the upper portion, the power pack including power electronics to operate the low voltage occupancy sensor;

at least one input conductor adapted to be electrically connected to line voltage; and at least one output conductor adapted to supply the upper portion with a low voltage, where the upper portion engages the lower portion to form a singular unit, and the power pack reduces the line voltage to the low voltage, and where the wiring terminals terminate in a terminal block of the upper portion, and the terminals of the lower portion are adapted to receive the terminal block.

* * * * *